US006920879B2

(12) United States Patent
Haeuser

(10) Patent No.: US 6,920,879 B2
(45) Date of Patent: Jul. 26, 2005

(54) COMPRESSED AIR BREATHING APPARATUS

(75) Inventor: Andreas Haeuser, Berlin (DE)

(73) Assignee: Auergesellschaft GmbH (DE)

( * ) Notice: Subject to any disclaimer, the term of this patent is extended or adjusted under 35 U.S.C. 154(b) by 0 days.

(21) Appl. No.: 09/951,116

(22) Filed: Sep. 13, 2001

(65) Prior Publication Data

US 2002/0078959 A1 Jun. 27, 2002

(30) Foreign Application Priority Data

Sep. 15, 2000 (DE) ..... 100 46 516

(51) Int. Cl.[7] ..... A62B 18/02

(52) U.S. Cl. ..... 128/205.22; 128/202.27; 128/201.27; 224/628; 224/148.4; 224/148.7

(58) Field of Search ..... 128/204.26, 205.22, 128/204.18, 202.27, 201.29, 201.27; 137/908; 224/583, 589, 628, 148.4, 148.7, 14.2; 169/51; 261/72.1; 405/185, 186

(56) References Cited

U.S. PATENT DOCUMENTS 2,085,249 A * 6/1937 Bullard ..... 128/205.12
2,362,643 A * 11/1944 Lambertsen ..... 128/205.12
2,758,596 A * 8/1956 Cupp ..... 128/204.25
2,764,151 A * 9/1956 Cupp ..... 128/202.22
3,680,556 A * 8/1972 Morgan ..... 128/201.15
3,791,403 A * 2/1974 Folkerth ..... 137/343
3,957,183 A * 5/1976 Gadberry ..... 224/628
4,049,164 A * 9/1977 Sullivan et al. ..... 224/633
4,062,356 A * 12/1977 Merrifield ..... 128/205.22
4,068,657 A * 1/1978 Kobzan ..... 128/202.14
4,250,876 A * 2/1981 Kranz ..... 128/202.22
4,327,851 A * 5/1982 Feathers ..... 224/634
4,377,163 A * 3/1983 Feathers ..... 128/205.22
4,498,471 A * 2/1985 Kranz et al. ..... 128/204.26
4,949,889 A * 8/1990 Carson ..... 224/270
4,951,755 A * 8/1990 Barnett et al. ..... 169/26
5,123,409 A * 6/1992 Sheffield et al. ..... 128/204.18
5,492,110 A * 2/1996 Lenz et al. ..... 128/202.22
5,685,239 A * 11/1997 Bentley ..... 109/50
6,405,728 B1 * 6/2002 Van Hall et al. ..... 128/205.22

* cited by examiner

*Primary Examiner*—Glenn K. Dawson
*Assistant Examiner*—Darwin P Erezo
(74) *Attorney, Agent, or Firm*—Wood, Phillips, Katz, Clark & Mortimer

(57) ABSTRACT

A compressed air breathing apparatus having a base plate, at least one compressed air bottle detachably mounted to the base plate using a fastening strap and an additional fixing device, and a high-pressure fitting attached to the at least one compressed air bottle. The at least one additional fixing device has at least one mounting hole which is provided in the base plate and a fixing piece on the high-pressure fitting capable of being moved directly into and locked in the mounting hole.

3 Claims, 2 Drawing Sheets

RESPIRATOR FITTING 10b
PRESSURE REDUCER 10a 6
10
9
9b
9c
9a
9b
9c
8a
8b
6

2
5
1
4
3
8a
8b
8
1

COMPRESSED AIR BREATHING APPARATUS

BACKGROUND OF THE INVENTION

Field of the Invention

This invention relates to a compressed air breathing apparatus comprising a base plate, at least one compressed air bottle that is detachably mounted to said base plate using a fastening strap and an additional fixing device and has a high-pressure fitting with a pressure reducer connected to it, and a respirator fitting.

Such compressed air breathing apparatuses are used by people who have to be in toxic, low-oxygen, or otherwise hazardous atmospheres and are usually exposed to high physical strain. For example, fire fighters are equipped with such compressed air breathing apparatuses when fighting fires. The multitude of movements a fire fighter must perform when equipped with a compressed air breathing apparatus does not only require firm fit of the base plate strapped to the wearer's back, but also of the compressed air bottle that is detachably mounted to said base plate, or even multiple compressed air bottles of various sizes as may be required, so that the respective person will not be restricted in movement while performing his/her dangerous job, or exposed to extra risk caused by loosely fitting compressed air bottles. In addition, it is often vital in such risky jobs to be able to mount the compressed air bottle to the base plate or replace it fast and easily. This is all the more important when multiple compressed air bottles are equipped and have to be held in a stable position at the base plate throughout the job. In known designs of compressed air breathing apparatuses, the pressure reducer is rigidly mounted to the base plate while the compressed air bottle is held at the base plate by its connection to the pressure reducing valve and an additional fastening strap that is connected to the upper section of the base plate. It therefore takes considerable time to mount or replace a compressed air bottle. However, when multiple compressed air bottles that may even differ in shape and size are to be mounted to the base plate, complex tee and/or angular fittings have to be inserted between the pressure reducer and each compressed air bottle to connect said bottles to the pressure reducer and mount them to the base plate. At the same time, mounting or replacing compressed air bottles becomes more complicated or takes longer. Moreover, the pressure reducer via which said compressed air bottle is to be fastened to the base plate may come loose or be placed at an inappropriate position for mounting the compressed air bottle(s) required so that these cannot be fastened safely, or not be mounted at all.

SUMMARY OF THE INVENTION

It is therefore the problem of this invention to provide a compressed air breathing apparatus with such a system of mounting compressed air bottles to the base plate that multiple compressed air bottles, even bottles of various sizes, can be mounted easily and safely and replaced in a minimum amount of time.

This problem is solved according to the invention by the compressed air breathing apparatus comprising the characteristics described in claim 1.

The subordinate claims disclose further important characteristics and advantageous improvements of the invention.

The general concept of the invention is to provide at least one mounting hole in the lower section of the base plate and a fixing piece protruding in a generally horizontal position from the high-pressure fitting at the compressed air bottle that fastens said compressed air bottle to prevent horizontal and vertical movement after the fixing piece has been inserted into the mounting hole, thereby ensuring fast mounting and safe retention of the compressed air bottle(s).

Multiple compressed air bottles that may differ in shape and size can be independently mounted to the base plate without requiring extra tools by providing multiple mounting holes in the base plate and by molding a preferably one-piece fixing piece that can be interlocked with these mounting holes to the high-pressure fitting of each compressed air bottle.

The pressure reducer is either integrated into the high-pressure fitting or separated from it by a high-pressure line.

The mounting hole in the base plate has the shape of a keyhole with a generally circular plug-in aperture followed by a narrow locking slit. The fixing piece comprises at least one latch plate on a narrow bridge that is about as wide as the locking slit, said latch plate fitting tightly to the base plate behind the locking slit after the fixing piece has been inserted into the plug-in aperture, thereby fastening the compressed air bottle at its lower section while its upper section is conventionally held by a fastening strip.

According to another characteristic of the invention, two latch plates are placed on the bridge at a distance from each other that engage the base plate near the locking slit.

The inner sides of these latch plates may be cone-shaped to easily slide into the locking slit and be vertically jammed in for locking purposes.

An advantageous improvement of the invention can be a locking slit that is wholly or partly beveling off the vertical line, or curved, thus further limiting any vertical movement of the compressed air bottle.

An embodiment of the invention that illustrates other characteristics and advantageous designs shall be explained in greater detail with reference to the figures. Wherein:

DETAILED DESCRIPTION OF THE DRAWINGS

Figures 1, 2, 5:
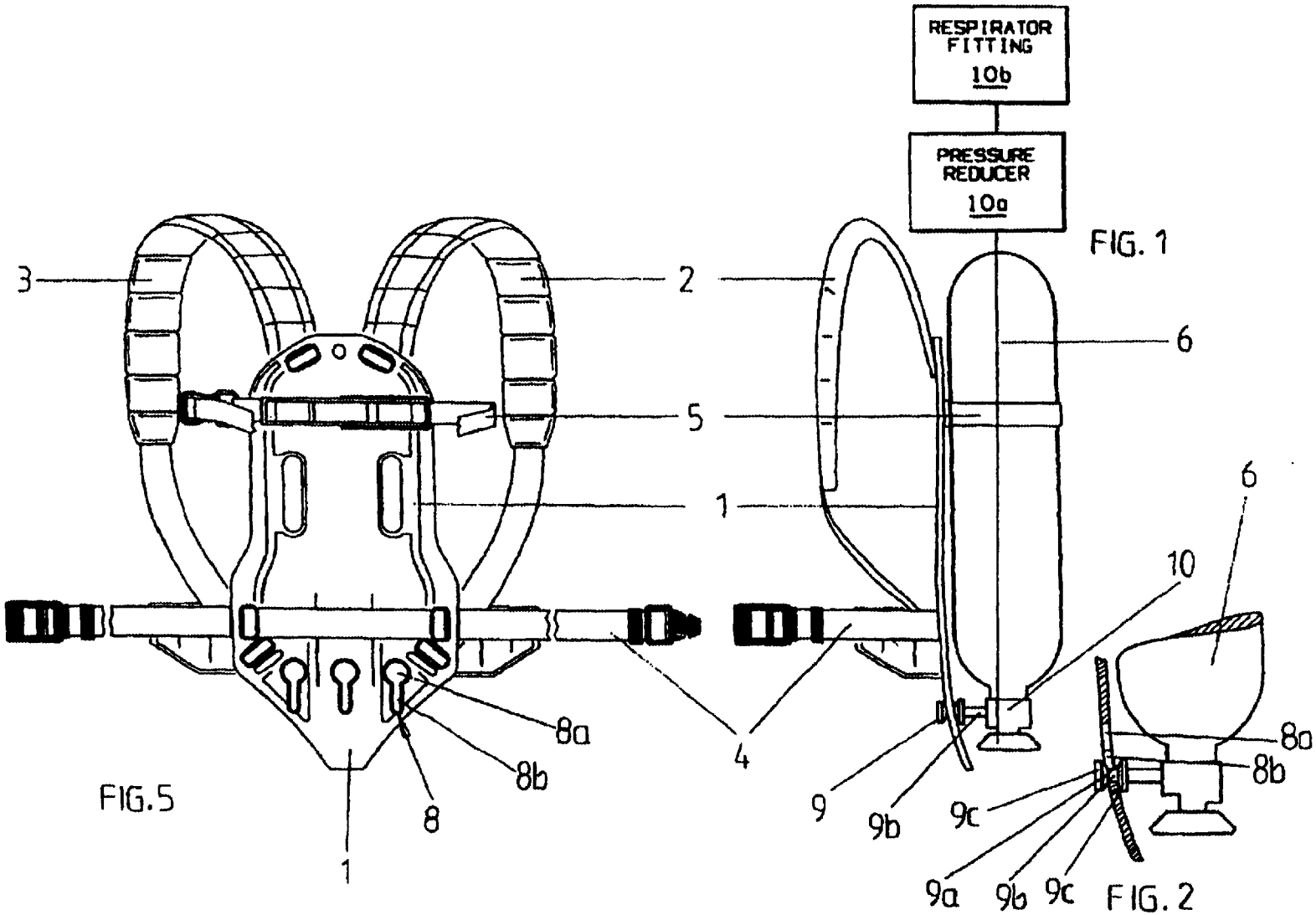
FIG. 1 shows a side view of a compressed air breathing apparatus with a single compressed air bottle mounted to the base plate according to the invention.
FIG. 2 shows a detailed view of the mounting system for the lower section of the compressed air bottle with a fixing piece formed by two latch plates on a bridge.
FIG. 5 shows a front view of a base plate without compressed air bottles mounted to it.

As shown in the figure, the compressed air breathing apparatus comprises a generally flat base plate 1 with two back straps 2, 3 and a waist strap 4 for tying it to a wearer's back, so that the plane of the flat plate 1 extends generally vertically, as well as a fastening strap 5 for fixing one or two compressed air bottles 6, 7 to the upper section of said base plate 1. As FIG. 5 shows, the lower section of the base plate 1 comprises three keyhole-shaped mounting holes 8, each formed by a circular plug-in aperture 8*a* on the top and a locking slit 8*b* underneath, the latter running in vertical direction here. The width of the locking slit 8*b* is clearly smaller than the diameter of the plug in aperture 8*a*. Unlike the representation in the figure, the slit may also run at an angle to the vertical line or start out in vertical direction and than become diverted at an angle (or vice versa), or run in a different way, for example, form a curve.

A high-pressure fitting 10 with an integrated pressure reducer 10*a* from which a medium pressure line 11 runs to a respiratory fitting 10*b* for a user is mounted to the compressed air bottle 6, 7. An external pressure reducer may also be connected via a high-pressure line to said high-pressure fitting 10.

The high-pressure fitting 10 is connected via a bridge 9*b* with two latch plates 9*c* placed at a distance from each other on said bridge to form a fixing groove 9*a*. Thus a fixing piece 9 for holding the compressed air bottle(s) 6, 7 in the locking slit 8*b* of base plate 1 is molded in one piece to the high-pressure fitting 10 on the compressed air bottle. The diameter of the latching plates 9*c*, which have a cone-shaped inner side in the embodiment described here, is slightly smaller than the diameter of the plug-in aperture 8*a* while the diameter of that part of bridge 9*b* that is engaged between the latch plates 9*c* is equal to or slightly smaller than the width of the locking slit 8*b*, and the length of that bridge part is about the same as the thickness of base plate 1.

Now a compressed air bottle 6, 7 equipped with a fixing piece 9 on its high-pressure fitting 10 can be easily fastened by inserting the fixing piece 9 into the plug-in aperture 8*a* of the mounting hole 8 with the bridge 9*b*, and fixing piece 9 thereon, projecting horizontally and substantially at a right angle to the plane of the plate 1, and subsequent lowering of the compressed air bottle between the two latch plates 9*c* into the locking slit 8*b*, which prevents it from moving in horizontal directions while its vertical movement is blocked by gravitation or a nonvertical design of the locking slit 8*b*. The fastening strap 5 holds the compressed air bottle(s) at their upper section.

Figure 4:
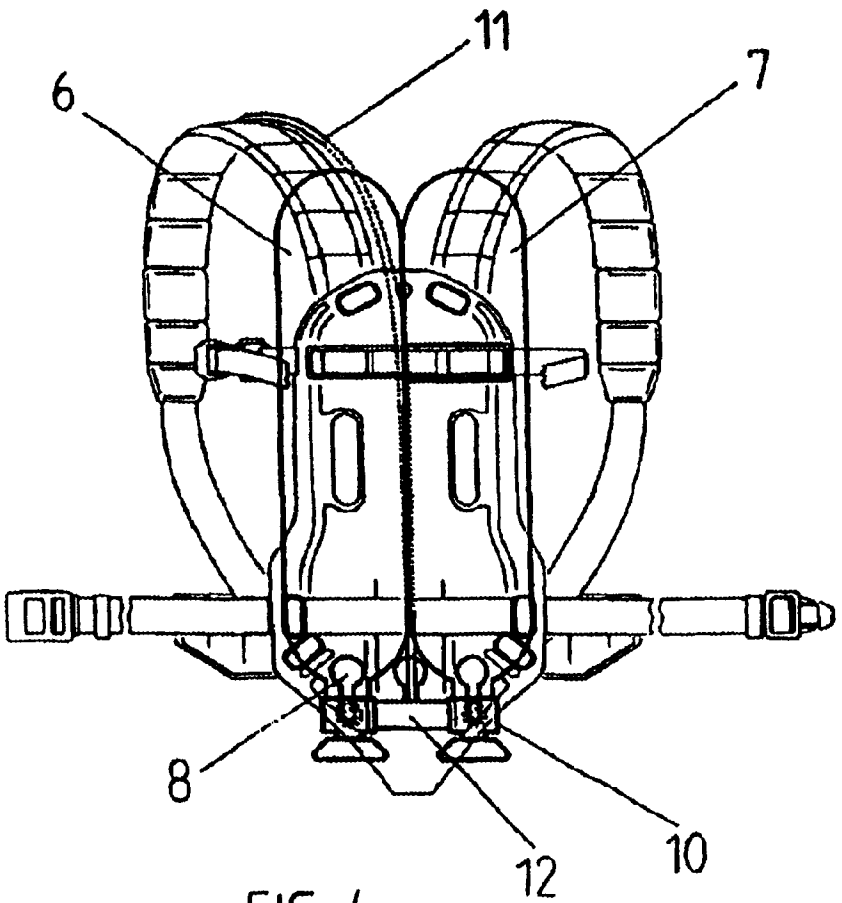
FIG. 4 shows a front view of a compressed air breathing apparatus with two compressed air bottles mounted to the base plate.
Figure 3:
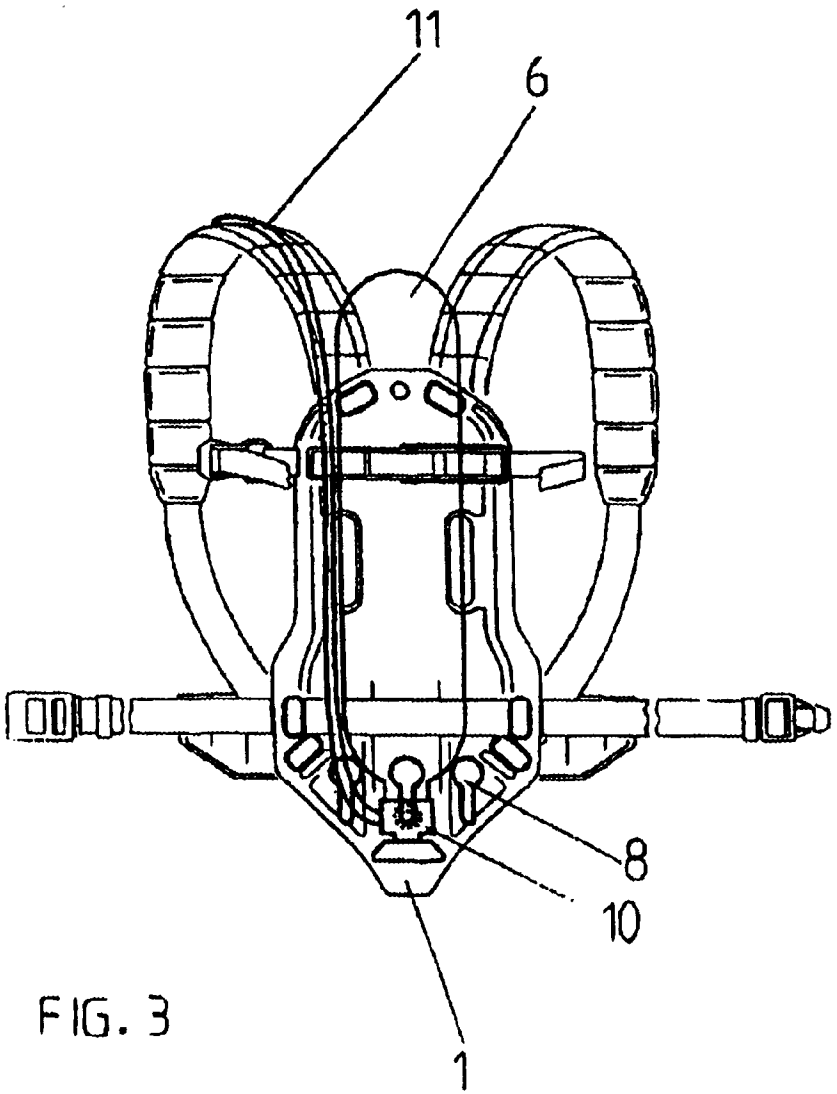
FIG. 3 shows a front view of the compressed air breathing apparatus according to FIG. 1.

According to FIGS. 3 to 5, the base plate 1 comprises three keyhole-shaped mounting holes 8 positioned on the same level next to each other, and according to FIG. 3 a single compressed air bottle is mounted to the base plate 1 using the center mounting hole 8. However, as FIG. 4 shows, two compressed air bottles 6, 7 that may differ in shape and size can be plugged separately into the left and right mounting holes 8 of that same base plate. The two high-pressure fittings 10 may be connected via a pressure reducer 12 from which a medium pressure line 11 leads to the respiratory fitting (not shown) for the respective user. It is also conceivable that a joint fixing piece is mounted to the joint pressure reducer 12 in order to plug both compressed air bottles 6, 7 into a single (center) mounting hole.

The invention is not restricted to the embodiment described above, as various modifications regarding the shape, number, and arrangement of the mounting holes and the specific design of the fixing piece are conceivable within the general concept of the invention. For example, embodiment comprising just one latch plate or a different shape of the latch plate could be envisaged.

I claim:

1. A compressed air breathing apparatus comprising: a base plate; at least one compressed air bottle detachably mounted to said base plate using a fastening strap and an additional fixing device; and a high-pressure fitting attached to the at least one compressed air bottle, wherein the at least one additional fixing device comprises at least one mounting hole provided directly in said base plate and a fixing piece on the high pressure fitting that projects towards the base plate and is capable of being moved directly into and locked in said mounting hole, wherein said mounting hole has a keyhole design with a generally circular plug-in aperture contiguous with a locking slit, and said fixing piece comprises at least one latch plate that is linked to said high-pressure fitting via a bridge so that, after insertion into said plug-in aperture, the fixing piece and bridge lock into said locking slit and fix said at least one compressed air bottle to said base plate, said compressed air breathing apparatus further comprising a second latch plate on the bridge and the one and second latch plates are and placed at a distance from each other and define a fixing groove and said base plate engages in said fixing groove at the locking slit.

2. The compressed air breathing apparatus according to claim 1 wherein said one and second latch plates of said fixing piece are designed as cylinders each with a perimeter, and the fixing groove runs along the perimeters.

3. The compressed air breathing apparatus according to claims 1 or 2 wherein said one and second latch plates of said fixing piece form a double cone with a tapering fixing groove and the bridge runs within said groove.

* * * * *